US011400572B2

(12) United States Patent
Jaskot et al.

(10) Patent No.: US 11,400,572 B2
(45) Date of Patent: Aug. 2, 2022

(54) DRY-FIRE BYPASS FOR A FASTENING TOOL

(71) Applicant: BLACK & DECKER INC., New Britain, CT (US)

(72) Inventors: Erin Elizabeth Jaskot, Richmond, VA (US); Michael P. Baron, Phoenix, MD (US); Stuart E. Garber, Towson, MD (US)

(73) Assignee: Black & Decker, Inc., New Britain, CT (US)

( * ) Notice: Subject to any disclaimer, the term of this patent is extended or adjusted under 35 U.S.C. 154(b) by 182 days.

(21) Appl. No.: 15/629,871

(22) Filed: Jun. 22, 2017

(65) Prior Publication Data

US 2018/0001453 A1 Jan. 4, 2018

Related U.S. Application Data

(60) Provisional application No. 62/356,973, filed on Jun. 30, 2016.

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC ..... B25C 1/06; B25C 1/008
USPC ..... 227/8, 120
See application file for complete search history.

(56) References Cited

U.S. PATENT DOCUMENTS

| | | | |
|---|---|---|---|
| 1,526,025 | A | 2/1925 | Street |
| 2,594,605 | A | 4/1952 | Zoppelt |
| 2,745,689 | A | 5/1956 | Balint et al. |
| 2,822,698 | A | 2/1958 | Gross |
| 2,979,725 | A | 4/1961 | Wandel et al. |
| 3,172,124 | A | 3/1965 | Kremiller |
| 3,225,443 | A | 12/1965 | Young |

(Continued)

FOREIGN PATENT DOCUMENTS

| | | |
|---|---|---|
| DE | 29917830 U1 | 3/2000 |
| EP | 0218778 A1 | 4/1987 |

(Continued)

OTHER PUBLICATIONS

Copenheaver, Blaine R.—International Search Report and Written Opinion re: related application No. PCT/US2017/039723—dated Sep. 6, 2017—7 pages.

(Continued)

*Primary Examiner* — Anna K Kinsaul
*Assistant Examiner* — Veronica Martin
(74) *Attorney, Agent, or Firm* — Rhonda Barton

(57) ABSTRACT

A fastening tool includes a contact trip operatively associated with a contact trip switch to enable a fastener drive system to be fired when the contact trip reaches a firing position, after having engaged a work surface. If a dry-fire condition exists in a magazine connected to the fastening tool, the movement of the contact trip is completely taken up or absorbed by a biasing agent so that the contact trip switch is not closed. The biasing agent also limits the amount of force that can be applied to the contact trip switch in the event an operator slams the contact trip against a work surface or drops the fastening tool nose-first onto an unyielding surface.

11 Claims, 11 Drawing Sheets

(56) References Cited

U.S. PATENT DOCUMENTS 3,480,210 A 11/1969 Perrinjaquet
3,563,438 A 2/1971 Doyle et al.
3,570,739 A 3/1971 Volkmann et al.
3,603,281 A 9/1971 Froelich
3,658,229 A 4/1972 Pomeroy
3,659,768 A 5/1972 Brunelle
3,743,159 A 7/1973 Schneider
3,765,588 A 10/1973 Frederickson
3,768,846 A 10/1973 Hensley et al.
3,774,293 A 11/1973 Golsch
3,820,705 A 6/1974 Beals
3,827,822 A 8/1974 Converse
3,890,058 A 6/1975 Self et al.
3,893,610 A 7/1975 Smith
3,979,040 A 9/1976 Denin
4,033,499 A 7/1977 Butler
4,049,181 A 9/1977 Kametaki
4,129,240 A 12/1978 Geist
4,186,862 A 2/1980 Klaus
4,197,974 A 4/1980 Morton et al.
4,230,249 A 10/1980 Nasiatka et al.
4,270,587 A 6/1981 Ludy
4,270,687 A 6/1981 Maurer
4,304,349 A 12/1981 Novak et al.
4,313,552 A 2/1982 Maurer
4,314,782 A 2/1982 Beekenkamp
4,316,513 A 2/1982 Harris
4,389,012 A 6/1983 Grikis et al.
4,403,725 A 9/1983 Lawrence
4,404,894 A 9/1983 Oesterle
4,416,172 A 11/1983 Medinger
4,424,929 A 1/1984 Weis
4,468,159 A 8/1984 Oster
4,485,952 A 12/1984 Weis
4,487,355 A 12/1984 Ginnow et al.
4,519,535 A 5/1985 Crutcher
4,558,811 A 12/1985 Klaus
4,566,621 A 1/1986 Becht
4,597,517 A 7/1986 Wagdy
4,667,747 A 5/1987 Falls et al.
4,765,786 A 8/1988 Krogh
4,807,793 A 2/1989 Ghibely
4,834,342 A 5/1989 Padgett
4,854,393 A 8/1989 Palet
4,863,089 A 9/1989 McCardle et al.
4,912,848 A 4/1990 Bidanset
4,967,623 A 11/1990 Jackson
5,025,968 A 6/1991 Nasiatka
5,074,453 A 12/1991 Tachihara et al.
5,134,812 A 8/1992 Hoffman et al.
5,165,827 A 11/1992 Miller
5,192,012 A 3/1993 Schafer et al.
5,261,588 A 11/1993 Lin
5,297,886 A 3/1994 Jansen et al.
5,368,213 A 11/1994 Massar
5,405,071 A 4/1995 Baugus
5,462,127 A 10/1995 Svensson
5,478,002 A 12/1995 Clement et al.
5,484,094 A 1/1996 Gupta
5,495,973 A 3/1996 Ishizawa et al.
5,575,051 A 11/1996 Moore
5,588,577 A 12/1996 Chen
5,647,525 A 7/1997 Ishizawa
5,649,661 A 7/1997 Masuno et al.
5,683,024 A 11/1997 Eminger et al.
5,695,108 A 12/1997 Lee
5,711,471 A 1/1998 White
5,779,145 A 7/1998 Zelle et al.
5,782,395 A 7/1998 Sauer
5,813,588 A 9/1998 Lin
5,816,468 A 10/1998 Yang
5,831,817 A 11/1998 Chang
5,921,562 A 7/1999 Robison
5,931,364 A 8/1999 Dennis
6,036,072 A 3/2000 Lee
6,053,389 A 4/2000 Chu et al.
6,056,181 A 5/2000 Chuang
6,112,831 A 9/2000 Gustafsson
6,131,787 A 10/2000 Curtis
6,145,723 A 11/2000 Gupta
6,149,046 A 11/2000 Ho et al.
6,161,744 A 12/2000 Mukoyama et al.
6,199,739 B1 3/2001 Mukoyama et al.
6,308,879 B1 10/2001 Wang
6,364,192 B1 4/2002 Lin
6,371,348 B1 4/2002 Canlas et al.
6,394,332 B2 5/2002 Akiba
6,431,428 B1 8/2002 Chen
6,557,743 B2 5/2003 Schuster
6,585,142 B1 7/2003 Chen
6,598,775 B1 7/2003 Chen
6,598,777 B2 7/2003 Osuga et al.
6,641,018 B2 11/2003 Akiba
6,672,497 B2 1/2004 Lin
6,691,907 B1 2/2004 Chang
6,769,591 B2 8/2004 Yamamoto et al.
6,789,718 B2 9/2004 Canlas et al.
6,796,475 B2 9/2004 Adams
6,805,272 B1 10/2004 Sen-Mu et al.
D498,127 S 11/2004 Leasure
6,814,156 B2 11/2004 Dieterle et al.
6,908,021 B1 6/2005 Wang
6,913,180 B2 7/2005 Schuster
6,918,527 B2 7/2005 Hakozaki et al.
D509,418 S 9/2005 Leasure
6,948,647 B1 9/2005 Niblett et al.
6,966,477 B1 11/2005 Chien-Kuo et al.
6,971,567 B1 12/2005 Cannaliato et al.
6,974,061 B2 12/2005 Adams et al.
6,974,062 B2 12/2005 Akiba
6,978,920 B2 12/2005 Hamada et al.
7,000,294 B2 2/2006 Kakuda et al.
D520,839 S 5/2006 Miwa
7,055,728 B2 6/2006 Lin
7,086,573 B1 8/2006 Wen
7,100,475 B1 9/2006 Rufolo, Jr.
7,134,586 B2 * 11/2006 McGee ..... B25C 1/005 227/127
7,137,541 B2 11/2006 Baskar et al.
7,138,595 B2 11/2006 Berry et al.
7,140,524 B2 11/2006 Hung et al.
7,143,921 B2 12/2006 Hakozaki et al.
7,165,305 B2 1/2007 Kenney et al.
7,204,403 B2 4/2007 Kenney et al.
7,210,607 B2 5/2007 Niblett et al.
D551,931 S 10/2007 Leasure
7,285,877 B2 10/2007 Gorti et al.
D556,003 S 11/2007 Buck
7,303,103 B2 12/2007 Wang
7,322,506 B2 1/2008 Forster
D562,664 S 2/2008 Buck
7,328,826 B2 2/2008 Shkolnikov
7,331,403 B2 2/2008 Berry et al.
7,410,084 B1 8/2008 Reed
7,413,103 B1 8/2008 Ho et al.
7,451,735 B2 11/2008 Riley et al.
7,469,811 B2 12/2008 Shima et al.
7,470,081 B2 12/2008 Miyahara et al.
7,484,647 B2 2/2009 Yang
7,494,036 B2 2/2009 Shima et al.
7,497,058 B2 3/2009 Mårtensson
7,503,401 B2 3/2009 Gross et al.
7,513,402 B2 4/2009 Miyashita et al.
7,516,532 B2 4/2009 Wojcicki
7,552,852 B2 6/2009 Haskins et al.
7,556,184 B2 7/2009 Brendel et al.
7,559,447 B2 7/2009 Chen et al.
7,565,992 B2 7/2009 Buetow
7,571,844 B2 8/2009 Bromley et al.
7,575,140 B2 8/2009 Jiang
7,575,141 B1 8/2009 Liang et al.
7,575,142 B2 8/2009 Liang et al.
7,600,662 B2 10/2009 Nayrac et al.
7,637,408 B2 12/2009 Takahashi et al.

(56) References Cited

U.S. PATENT DOCUMENTS 7,646,157 B2 1/2010 Cruise et al.
7,654,430 B2 2/2010 Cho et al.
7,686,199 B2 3/2010 Gross et al.
7,690,546 B2 4/2010 Cortez
7,708,505 B2 5/2010 Opsitos, Jr. et al.
7,726,536 B2 6/2010 Gross et al.
7,748,588 B2 7/2010 Osuga et al.
7,753,243 B2 7/2010 Brendel et al.
7,762,443 B2 7/2010 Tamura et al.
7,784,238 B2 8/2010 Bannister
7,788,997 B2 9/2010 Kozak et al.
7,789,169 B2 9/2010 Berry et al.
7,870,987 B1 1/2011 Zhang et al.
7,874,469 B2 1/2011 Liu
7,905,377 B2 3/2011 Krondorfer et al.
7,930,960 B2 4/2011 Duginske
7,934,565 B2 5/2011 Krondorfer et al.
7,934,566 B2 5/2011 Hlinka et al.
7,959,049 B2 6/2011 Dittrich et al.
7,975,893 B2 7/2011 Berry et al.
7,980,439 B2 7/2011 Akiba et al.
7,980,441 B2 7/2011 Dittrich et al.
7,997,467 B2 8/2011 Hirabayashi et al.
8,011,441 B2 9/2011 Leimbach et al.
8,011,547 B2 9/2011 Leimbach et al.
8,011,549 B2 9/2011 Berry et al.
8,025,197 B2 9/2011 Brendel et al.
8,042,717 B2 10/2011 Lam et al.
RE42,987 E 12/2011 Akiba
8,091,752 B2 1/2012 Jian et al.
8,104,658 B2 1/2012 Yu
8,123,099 B2 2/2012 Kenney et al.
8,136,606 B2 3/2012 Krondorfer et al.
8,167,182 B2 5/2012 Shima et al.
8,172,814 B2 5/2012 Cane'
8,230,941 B2 7/2012 Leimbach et al.
8,231,039 B2 7/2012 Buck et al.
8,240,534 B2 8/2012 Hirabayashi
8,256,528 B2 9/2012 Oesterle et al.
8,267,296 B2 9/2012 Leimbach et al.
8,267,297 B2 9/2012 Leimbach et al.
8,286,722 B2 10/2012 Leimbach et al.
8,292,143 B2 10/2012 Lee et al.
8,302,833 B2 11/2012 Gross et al.
8,313,012 B2 11/2012 Shima et al.
8,347,978 B2 1/2013 Forster et al.
8,381,830 B2 2/2013 Puzio et al.
8,387,718 B2 3/2013 Leimbach et al.
8,387,846 B2 3/2013 Francis et al.
8,408,327 B2 4/2013 Forster et al.
8,434,566 B2 5/2013 Forster et al.
8,439,242 B2 5/2013 Tanji et al.
8,505,798 B2 8/2013 Simonelli et al.
8,534,527 B2 9/2013 Brendel et al.
8,602,282 B2 12/2013 Leimbach et al.
8,631,986 B2 1/2014 Hlinka et al.
8,684,246 B2 4/2014 Liang et al.
8,763,874 B2 7/2014 McCardle et al.
8,777,081 B2 7/2014 Chen et al.
8,827,132 B2 9/2014 Mina et al.
8,925,233 B2 1/2015 Thordsen
8,991,675 B2 3/2015 Liang et al.
8,997,744 B2 4/2015 Ho et al.
9,010,493 B2 4/2015 Jagdale et al.
9,038,305 B2 5/2015 Volfson
9,120,028 B2 9/2015 Wilson
9,126,319 B2 9/2015 Gross et al.
9,194,637 B2 11/2015 Mather
9,346,156 B1 5/2016 Fago
9,346,158 B2 5/2016 Garber et al.
9,399,281 B2 7/2016 Brendel et al.
9,459,075 B1 10/2016 Hatcher
9,469,021 B2 10/2016 Gregory et al.
9,486,904 B2 11/2016 Gregory et al.
9,498,871 B2 11/2016 Gregory et al.
9,527,196 B2 * 12/2016 Segura ..... B25C 1/008
9,577,493 B2 2/2017 Ekstrom et al.
9,643,200 B2 5/2017 Belanger
9,643,305 B2 5/2017 Gregory et al.
9,649,755 B2 5/2017 Gregory et al.
9,676,088 B2 6/2017 Leimbach et al.
9,744,657 B2 8/2017 Baron et al.
9,827,658 B2 11/2017 Gregory et al.
9,868,196 B2 1/2018 Chien
10,265,840 B2 4/2019 Anstett et al.
10,434,634 B2 10/2019 Garber
10,562,163 B2 2/2020 Akiba
10,604,172 B2 3/2020 Yoon et al.
10,661,470 B2 5/2020 Bauer et al.
2001/0038026 A1 11/2001 Dickhaut
2002/0104866 A1 8/2002 Miller et al.
2002/0117532 A1 8/2002 Miller et al.
2002/0174807 A1 11/2002 Mason
2002/0185514 A1 12/2002 Adams et al.
2003/0038786 A1 2/2003 Nguyen et al.
2003/0146262 A1 8/2003 Hwang et al.
2003/0230622 A1 12/2003 Rotharmel
2004/0169057 A1 9/2004 Ronconi
2004/0222266 A1 11/2004 Kakuda et al.
2005/0166713 A1 8/2005 Lloyd
2005/0217416 A1 10/2005 Berry et al.
2005/0220445 A1 10/2005 Baskar et al.
2005/0242152 A1 11/2005 Ronconi
2006/0102685 A1 5/2006 Phillips et al.
2006/0231582 A1 10/2006 Hong et al.
2006/0248998 A1 11/2006 Duginske
2006/0272269 A1 12/2006 Bannister
2006/0273131 A1 12/2006 Chen
2007/0045345 A1 3/2007 Monfeli et al.
2007/0090148 A1 4/2007 Cho et al.
2007/0102471 A1 5/2007 Gross et al.
2007/0261868 A1 11/2007 Gross
2008/0054043 A1 3/2008 Beales
2008/0099525 A1 5/2008 Brendel et al.
2008/0135596 A1 * 6/2008 Wu ..... B25C 1/008
227/8
2008/0223894 A1 9/2008 Cruise et al.
2008/0283568 A1 11/2008 Nayrac et al.
2008/0290128 A1 11/2008 Buetow
2008/0296340 A1 12/2008 Wang
2009/0050668 A1 2/2009 Jian
2009/0084824 A1 4/2009 Jiang
2009/0108046 A1 4/2009 Huang
2009/0120281 A1 5/2009 Yang
2009/0145520 A1 6/2009 Opsitos, Jr. et al.
2009/0152323 A1 6/2009 Lin
2009/0266867 A1 10/2009 Mina et al.
2010/0057014 A1 3/2010 Cane
2010/0116863 A1 5/2010 Suda
2010/0301091 A1 12/2010 Liang et al.
2010/0308098 A1 12/2010 Francis et al.
2011/0057014 A1 3/2011 Yang et al.
2011/0114692 A1 5/2011 Liang et al.
2011/0132959 A1 6/2011 Hlinka et al.
2011/0198381 A1 8/2011 McCardle et al.
2011/0215131 A1 9/2011 Liang
2011/0278342 A1 11/2011 Kuo
2011/0315414 A1 12/2011 Kuntner et al.
2011/0315840 A1 12/2011 Connolly et al.
2012/0074194 A1 3/2012 Miller et al.
2012/0085806 A1 * 4/2012 Lee ..... B25C 1/008
227/8
2012/0187177 A1 7/2012 Myburgh et al.
2013/0029548 A1 1/2013 Stenzel et al.
2013/0032368 A1 2/2013 Zhang et al.
2013/0153254 A1 6/2013 Liang et al.
2013/0227869 A1 9/2013 Thordsen
2013/0240299 A1 9/2013 Jagdale et al.
2013/0306699 A1 11/2013 Baskar et al.
2013/0320059 A1 12/2013 Gregory et al.
2013/0320060 A1 12/2013 Gregory et al.
2013/0320063 A1 12/2013 Gregory et al.
2013/0320064 A1 12/2013 Gregory et al.
2013/0320065 A1 12/2013 Gregory et al.

(56) References Cited

U.S. PATENT DOCUMENTS

| | | | | |
|---|---|---|---|---|
| 2013/0320066 | A1 | 12/2013 | Gregory et al. | |
| 2013/0320067 | A1 | 12/2013 | Gregory et al. | |
| 2013/0320068 | A1* | 12/2013 | Gregory | B25C 1/00 227/139 |
| 2014/0069671 | A1 | 3/2014 | Leimbach et al. | |
| 2014/0097223 | A1 | 4/2014 | Baron et al. | |
| 2014/0158739 | A1 | 6/2014 | Grazioli et al. | |
| 2014/0252060 | A1* | 9/2014 | Segura | B25C 1/008 227/8 |
| 2014/0325886 | A1 | 11/2014 | Mather | |
| 2014/0361066 | A1 | 12/2014 | Liu et al. | |
| 2014/0373329 | A1 | 12/2014 | Volfson | |
| 2015/0096776 | A1 | 4/2015 | Garber | |
| 2015/0122867 | A1 | 5/2015 | Segura | |
| 2015/0352702 | A1 | 12/2015 | Chien | |
| 2016/0129573 | A1 | 5/2016 | Anstett et al. | |
| 2016/0368126 | A1* | 12/2016 | Liu | B25C 1/008 |
| 2017/0066116 | A1 | 3/2017 | Garber et al. | |
| 2017/0232600 | A1 | 8/2017 | King, Jr. | |
| 2018/0001454 | A1 | 1/2018 | Jaskot et al. | |
| 2018/0001456 | A1 | 1/2018 | Garber | |
| 2018/0015600 | A1 | 1/2018 | Akiba | |
| 2018/0281840 | A1 | 10/2018 | Yoon et al. | |
| 2018/0333888 | A1 | 11/2018 | Bauer et al. | |
| 2019/0091844 | A1 | 3/2019 | Akiba | |
| 2019/0299380 | A1 | 10/2019 | Meyer et al. | |

FOREIGN PATENT DOCUMENTS

| | | | |
|---|---|---|---|
| EP | 931625 | A2 | 7/1999 |
| EP | 1206337 | B1 | 10/2004 |
| EP | 1207017 | B1 | 8/2006 |
| EP | 1795305 | A1 | 6/2007 |
| EP | 1798003 | A1 | 6/2007 |
| EP | 1884322 | | 2/2008 |
| EP | 1864759 | B1 | 10/2010 |
| EP | 2301718 | A2 | 3/2011 |
| EP | 2105259 | B1 | 6/2011 |
| EP | 2065137 | B1 | 11/2011 |
| EP | 2105258 | B1 | 4/2012 |
| EP | 2441552 | A2 | 4/2012 |
| EP | 2687334 | B1 | 6/2016 |
| EP | 2711135 | B1 | 7/2016 |
| EP | 3243605 | B1 | 11/2017 |
| GB | 602455 | A | 5/1948 |
| JP | S5499276 | A | 8/1979 |
| JP | H06246649 | A | 9/1994 |
| JP | 2000354981 | A | 12/2000 |
| JP | 2002210676 | A | 7/2002 |
| WO | 2009046076 | A1 | 4/2009 |
| WO | 2015164032 | A1 | 10/2015 |

OTHER PUBLICATIONS

Extended European Search Report dated Nov. 20, 2017.
International Search Report and Written Opinion dated Nov. 2, 2017 in corresponding International Patent Application No. PCT/US2017/039988.
Office Action in corresponding European Patent Application No. 17737706.6 dated Feb. 13, 2020.
International Search Report and Written Opinion dated Oct. 12, 2017 in corresponding International Patent Application No. PCT/US2017/039981.
EESR dated Mar. 28, 2018 in corresponding U.S. Appl. No. 15/195,057.
Extended European Search Report dated Mar. 29, 2018 in corresponding U.S. Appl. No. 15/196,175.
Extended European Search Report, dated Jan. 28, 2020 in corresponding U.S. Appl. No. 15/637,720.
Extended European Search Report, dated Dec. 3, 2018 in corresponding U.S. Appl. No. 15/899,530.
EP Search Report, dated Jan. 4, 2018.
Feb. 13, 2020_EP_Office_Action_TN 15008.
Hilti DX460—at least as early as Mar. 17, 2016.
Hilti DX351—at least as early as Mar. 17, 2016.
Ramset XT540—at least as early as Mar. 17, 2016.
Hilti GX120—at least as early as Mar. 17, 2016.
Simpson GCN-MEPMAG—at least as early as Mar. 17, 2016.
Ramset Trackfast—at least as early as Mar. 17, 2016.
T3 Ramset—at least as early as Mar. 17, 2016.
Hilti GX2—at least as early as Mar. 17, 2016.
Communication pursuant to Article 94(3) EPC, dated Mar. 25, 2021, in corresponding EP application No. 17178226.1-1017.

* cited by examiner

DRY-FIRE BYPASS FOR A FASTENING TOOL

CROSS-REFERENCE TO RELATED APPLICATIONS

The present application claims priority under 35 U.S.C. § 119 to U.S. Provisional Application Ser. No. 62/356,973 filed on Jun. 30, 2016, which is herein incorporated by reference in its entirety.

BACKGROUND OF THE INVENTION

1. Field of the Invention

The present invention relates to fastening tools, and more particularly to fastening tools with fastener magazines, and having contact trips engageable with a work surface to enable the fastening tools to fire a fastener.

2. Description of the Related Art

Fastening tools, such as concrete nailers, staplers, and other nailers, are normally provided with fastener magazines. Typically, fasteners loaded in the magazine are biased toward a drive track of the fastening tool, so that the fastening tool drive system can drive a fastener into a work surface. However, if the supply of fasteners in the magazine becomes exhausted or "dry" when the fastening tool is fired, the driver of the drive system encounters no resistance as the driver is fired along the drive track, until the driver ultimately engages some other portion of the fastening tool, or even the work surface via the contact trip. This condition is called a "dry-fire", and is highly destructive to fastening tool mechanisms.

To date, conventional attempts to solve the problem have been unsatisfactory for several reasons. One reason is that many conventional dry-fire avoidance systems freeze a lower contact trip so that the lower contact trip is unable to move even if the lower contact trip is thrust against a work surface, an event which places additional stresses on the contact trip system.

Another reason is that conventional dry-fire avoidance systems often position the contact trip off-center from the fastening tool drive axis, which creates a moment arm with the contact trip. Consequently, when an operator slams the contact trip against a work surface, or drops the fastening tool, nose first, onto an unyielding surface, like concrete, the shock is amplified and transmitted throughout the entire contact trip system.

Conventional contact trip systems include three major elements: a contact trip, a dry-fire avoidance system, and a fastener drive system arming device. The fastener drive system arming device is linked to the contact trip so that, when the contact trip moves to a firing position after having engaged the work surface, the fastener drive system arming device assumes a firing condition enabling the fastener drive system, which is now armed, to drive a fastener. Then, when an operator pulls a trigger switch on the fastening tool, the fastening tool can fire a fastener. However, the vulnerability of conventional contact trip systems to being slammed or dropped significantly reduces the lifetimes of conventional arming devices.

Still another reason why conventional dry-fire avoidance systems have proven unsatisfactory is that, in electrically-driven fastening tools, the fastener drive system arming device often includes a relatively fragile contact trip switch, which is closed by a linkage actuated by the contact trip when the contact trip moves to the firing position. The contact trip switch is electrically connected to the fastener drive system so that, when the contact trip closes the contact trip switch, the fastener drive system arming device assumes the firing condition, and an operator can fire the fastening tool. However, conventional fastening tools include no systems for limiting the force exerted upon the contact trip switch when the contact trip is shoved against a work surface, even during normal operating conditions when the magazine is loaded with fasteners.

The problems enumerated above still exist in fastener drive system arming devices connected mechanically or otherwise to other types of fastener-driving systems, such as pneumatic, explosive-gas, or hydraulic. Impact forces exerted upon the lower portion of a contact trip assembly are still directly transmitted to the fastener drive system arming device.

Consequently, existing fastening tools are vulnerable both to dry-fire conditions and to shocks caused by the operator slamming the tool against a work surface, or dropping the tool nose-first onto an unyielding surface, like concrete. What is needed, therefore, is a fastening tool that both handles dry-fire conditions, and insulates an arming device from the forces exerted upon the arming device by a contact trip.

SUMMARY OF THE INVENTION

Accordingly, in one embodiment of the fastening tool of the present invention, the contact trip is moved to bypass a fastener drive system arming device. A biasing agent, such as a coil spring, is placed between the upper portion of the contact trip and the fastener drive system arming device. The coil spring allows the contact trip to move the entire distance the contact trip normally travels to reach the firing position, while taking up or absorbing the force that the contact trip would normally expend on the arming device. This arrangement yields several benefits.

One benefit of moving the contact trip to bypass the fastener drive system arming device is that the amount of force which is ultimately applied to an element of the fastener drive system arming device, namely a contact trip switch, can be limited by configuring the coil spring to be, in effect, a force take-up member. For example, in an electrically-driven fastening tool of the present invention, it is desirable that the contact trip switch survive hundreds of thousands of connections during the lifetime of the fastening tool. By configuring the coil spring to limit the force ultimately applied to the contact trip switch to two pounds or less, the contact trip switch will survive hundreds of thousands of connections, no matter how hard the operator slams the contact trip against a work surface, and no matter how many times the fastening tool is dropped.

Another benefit of moving the contact trip to bypass the fastener drive system arming device is that the coil spring acts as a distance take-up member, causing the contact trip to bypass direct engagement with the contact trip switch in response to a "bypass event". Such an event can include, for example, the fastener magazine reaching a dry-fire condition, in which the coil spring can be compressed to take up or absorb the entire distance that the contact trip travels to reach the firing position, without the contact trip engaging the arming device.

Yet another benefit of the bypass system of the present invention is that the system permits the contact trip to be disposed in the fastening tool housing coaxially with the fastening tool drive axis. Therefore, a lower portion of the fastening tool housing can now act as a "hard stop" against which a toe of the contact trip is driven if the contact trip is ever slammed against the concrete, or the fastening tool is dropped nose-first. Thus the inherently rugged fastening tool housing itself takes the shock, rather than the more fragile elements of the contact trip switch, which are simultaneously protected by the force-limiting action of the coil spring. The hard stop eliminates the shock-amplifying arrangement of conventional dry-fire avoidance systems that position the contact trip off-center from the drive axis.

The bypass system of the present invention is implemented by disposing the coil spring in a biasing agent housing between a plate or appendage connected for joint movement with an upper part of the contact trip, and an upper inner surface, or roof, of the biasing agent housing. The coil spring also normally biases the biasing agent housing in a direction to engage the fastener drive system arming device. Thus, as the contact trip moves upwardly in response to having engaged a work surface, it carries with it the appendage, which in turn pushes the coil spring upwardly in the biasing agent housing, thereby pushing the biasing agent housing upwardly as well. When the contact trip reaches the uppermost point in its travel (its firing position), the biasing agent housing engages a switch lever, which pivots to close the contact trip switch. The switch lever and contact trip switch collectively form the fastener drive system arming device.

On the other hand, if a dry-fire condition were to occur in the fastener magazine, a fastener pusher probe disposed in the fastener magazine blocks the biasing agent housing from moving upwardly. If an operator nevertheless were to cause the contact trip to engage a work surface, the contact trip will still move upwardly toward the firing position. As the contact trip moves upwardly, the contact trip again carries the appendage, which in turn pushes the coil spring upwardly. However, (inasmuch as the biasing agent housing is configured to permit relative movement between the biasing agent housing and the appendage, and inasmuch as upward movement of the biasing agent housing has been blocked), the upward movement of the contact trip will not close the contact trip switch. Instead, continued joint upward movement of the contact trip—appendage combination results in the coil spring being compressed inside the biasing agent housing, which still remains stationary. Thus, the coil spring takes up or absorbs the distance that the contact trip would normally travel to reach the firing position, thereby causing the upward movement of the contact trip to bypass the contact trip switch, but allowing the contact trip to move the entire distance the contact trip needs to travel to reach the firing position.

In another embodiment, the magazine fastener pusher probe pushes the biasing agent housing laterally away from the line of vertical movement the biasing agent housing would normally take to engage the switch lever, in response to the quantity of fasteners in the magazine having reached a minimum. When the magazine is fully loaded, the pusher is retracted and a return spring returns the biasing agent housing to a position in which the biasing agent housing is engageable with the switch lever. If desired, a force take-up member, such as another coil spring, may be operatively disposed between the biasing agent housing and the appendage to limit the force applied by the biasing agent housing against the switch lever.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the present invention, and such exemplifications are not to be construed as limiting the scope of the present invention in any manner.

DETAILED DESCRIPTION OF THE INVENTION

Figure 1:
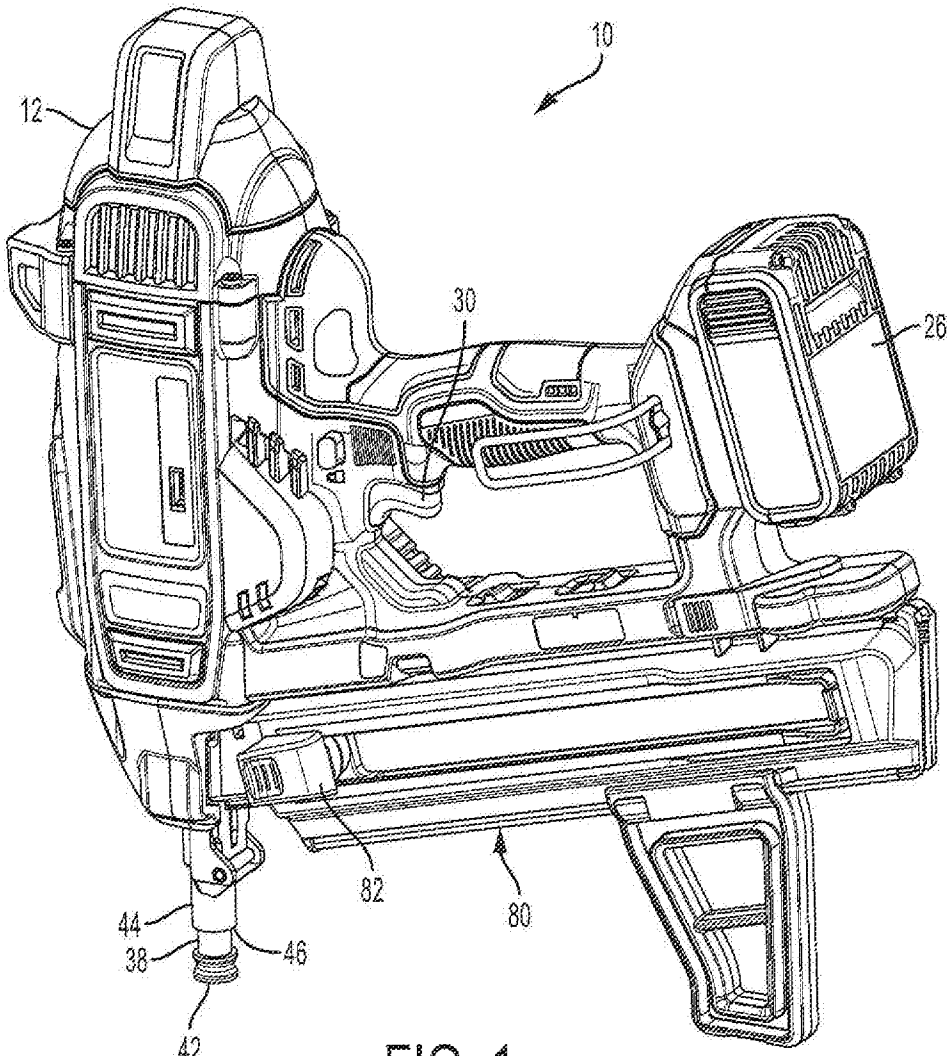
FIG. 1 is a perspective view of one embodiment of a fastening tool of the present invention.
Figure 2:
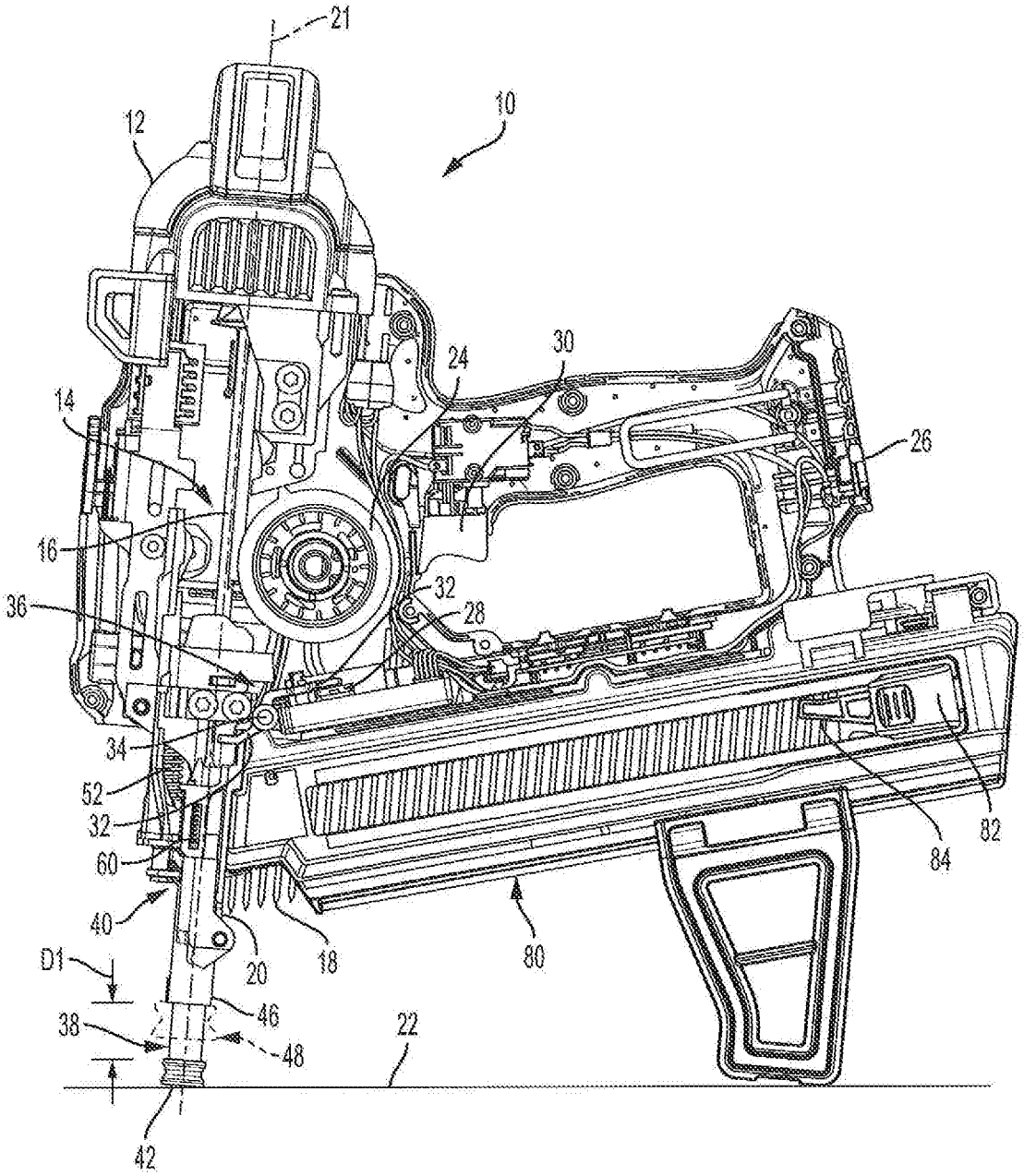
FIG. 2 is an elevational view of the fastening tool of FIG. 1, with portions of the housing removed for clarity, and illustrating the contact trip in its fully-extended position.
Figure 3:
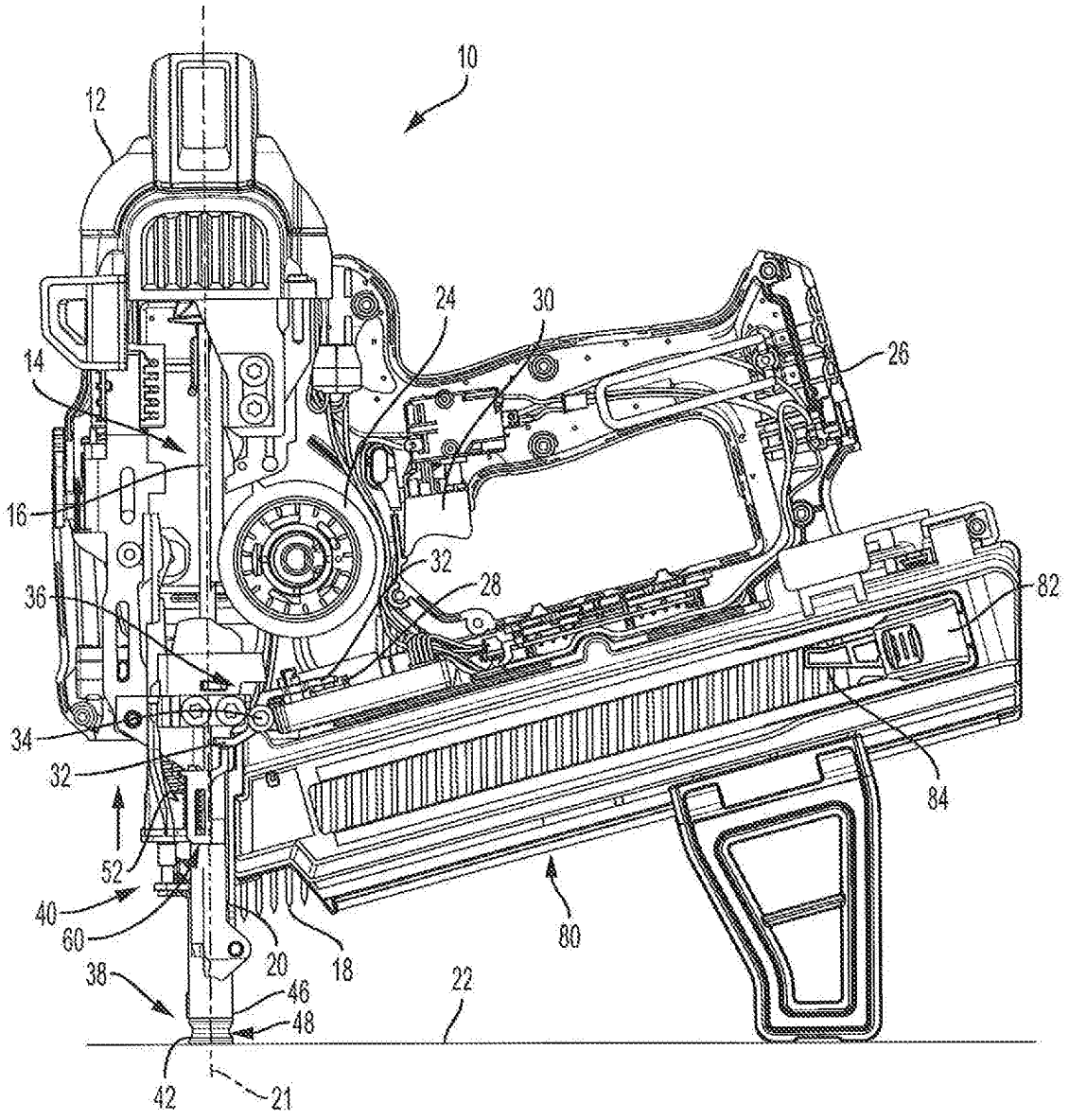
FIG. 3 is a view similar to that of FIG. 2, illustrating the contact trip in its fully-engaged position against a work surface.
Figure 4:
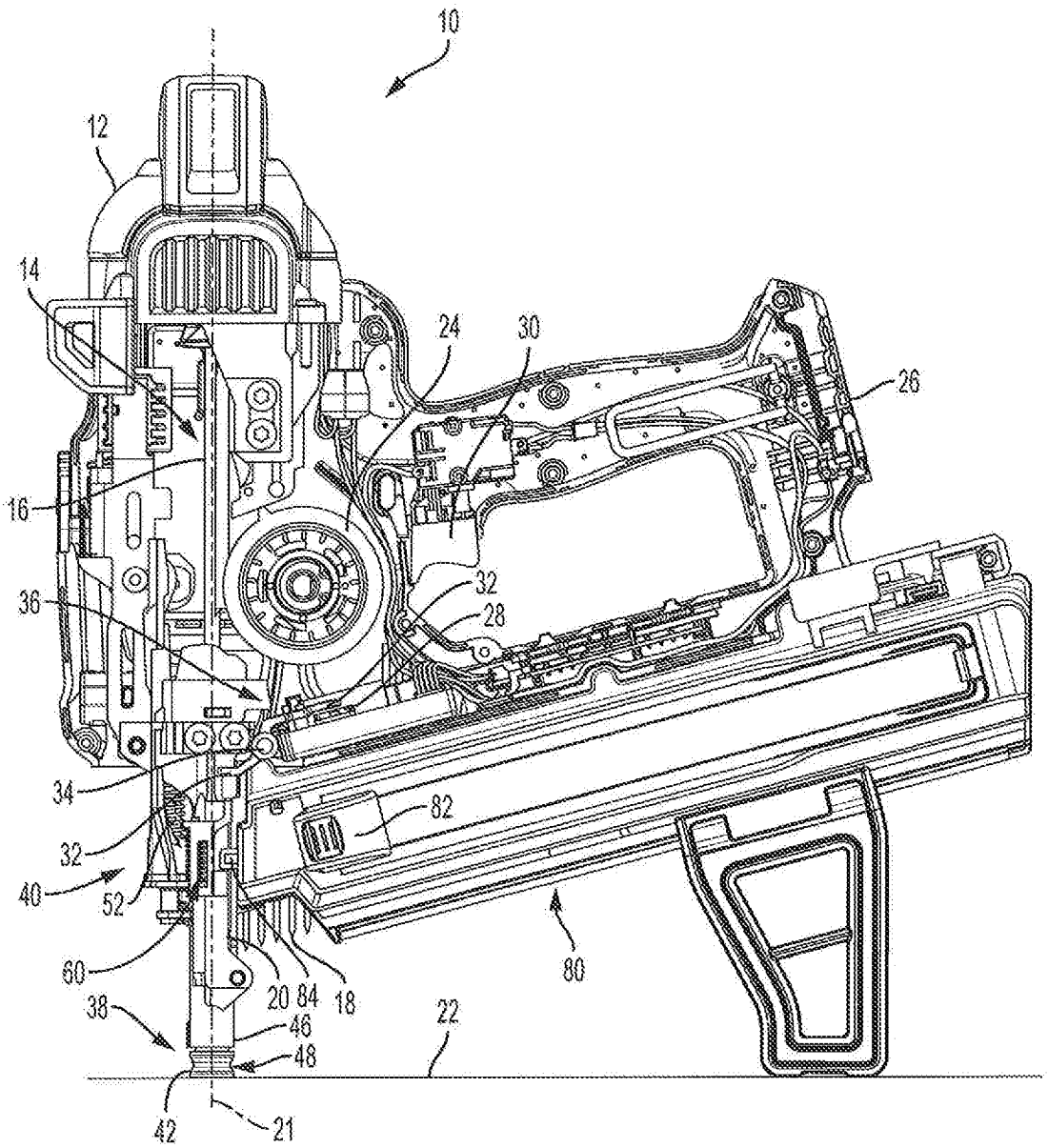
FIG. 4 is a view similar to that of FIG. 3, where a fastener pusher of a magazine is shown blocking a biasing agent housing from engaging a switch lever.

Referring now to the Drawings and particularly to FIGS. 1-4, a fastening tool 10 in accordance with an embodiment of the present invention includes a housing 12 and a fastener drive system 14 disposed in the housing (FIGS. 2-4). The fastener drive system 14 includes a driver 16 for driving fasteners 18 along a drive track 20 and a drive axis 21, and into a work surface 22. The fastener drive system 14 also includes a motor 24 powered by a battery 26 and operatively associated with the driver 16 to drive the fasteners 18. A contact trip switch 28 and a trigger switch 30 are electrically connected to the fastener drive system 14. Both the contact trip switch 28 and the trigger switch 30 must be closed before the fastening tool 10 fires. The contact trip switch 28, which is normally open, is closed in response to movement of a switch lever 32, which is pivotably mounted in the fastening tool housing 12 about a pivot 34. The contact trip switch 28 and switch lever 32 constitute an arming device 36. The arming device 36 is actuated in response to upward movement of a contact trip 38 when the contact trip is pressed against a work surface 22. When the contact trip switch 28 is closed by movement of the contact trip 38, the contact trip switch assumes a firing condition, thereby causing the fastener drive system 14 to be armed. The fastening tool 10 can now drive a fastener 18 when an operator presses the trigger switch 30. If the contact trip 38 does not engage the work surface 22, the contact trip switch 28 remains in a no-fire condition, and pressing the trigger switch 30 will not fire the fastening tool 10.

At this point, it should be noted that, although the embodiments of the fastening tool of the present invention depicted in the Drawings are shown as concrete nailers, it will be appreciated that the present invention can be incorporated in any fastening tool, including, without limitation, staplers and other nailers. Furthermore, although the embodiments of the dry-fire bypass system are shown being used in connection with a fastening tool having an electric-powered drive system, it will again be appreciated that the dry-fire bypass system may also be employed in fastening tools using pneumatic, hydraulic, and gas/explosive drive systems, among others.

The main elements of the dry-fire bypass system of the present invention include a contact trip assembly 40, a biasing agent housing assembly 60 and a magazine 80.

Referring now to FIGS. 2, 3, 4, 5A-5D, 6A, 6B, and 7-9, the contact trip assembly 40 includes the contact trip 38, having a contact trip toe 42, which engages the work surface 22. The contact trip 38 is movably disposed within a lower housing member 44, which in turn defines a lower portion 46, against which the contact trip toe 42 abuts when the contact trip reaches a firing position 48, as shown in FIGS. 3, 4, 5C, 5D, 6B, 8 and 9.

Figure 6B:
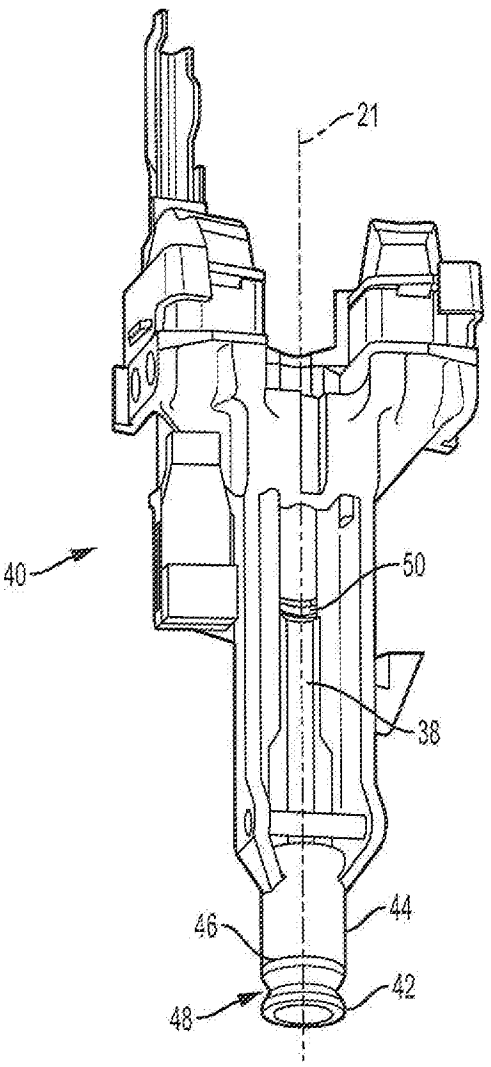
FIGS. 6A and 6B are partial perspective detail views of the contact trip assembly of FIGS. 5A-5D, taken from the rear, and illustrating the joint movement of the contact trip and an appendage.
Figure 6A:
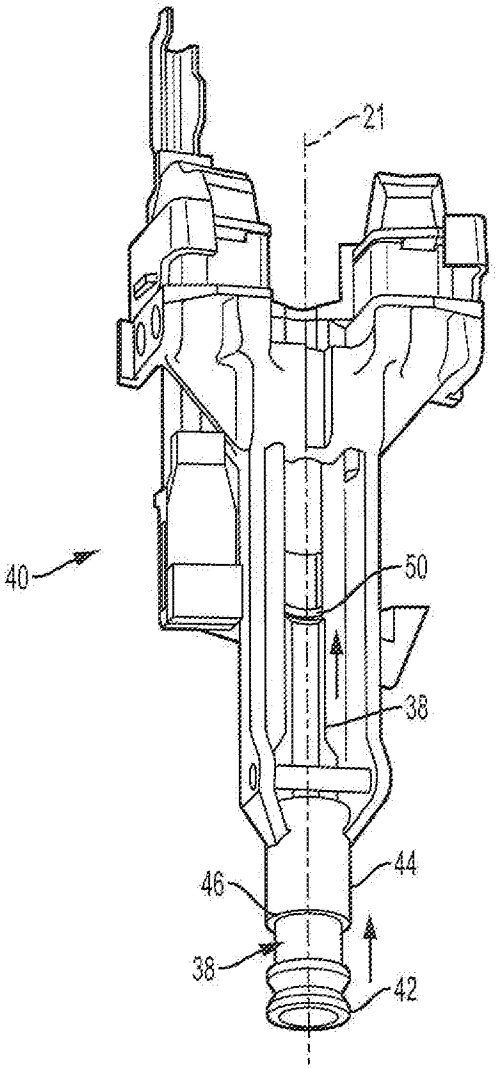

Referring to FIGS. 6A and 6B, the contact trip 38 moves upwardly within lower housing member 44 from a position where the contact trip is not fully engaged, as shown in FIG. 6A, to the contact trip firing position 48, shown in FIG. 6B. A plate or appendage 50 is attached to the contact trip 38 for joint movement with the contact trip.

Returning to FIGS. 5A-5D, a main coil spring 52, grounded at an upper end of the coil spring to the fastening tool housing 12, is connected to the appendage 50. Thus, the main coil spring 52 normally biases the contact trip 38 toward engagement with a work surface 22. It has been discovered that configuring the main coil spring 52 to exert of force of about 1.25 times the weight of the fastening tool 10 achieves the best results. That means a ten-pound fastening tool would require a main coil spring 52 capable of exerting 12.5 pounds of force against the appendage 50 and contact trip 38 combination. Still referring to FIGS. 5A-5D, the appendage 50 is threaded onto a bushing 54, which slides along a bushing rod 56. Thus the appendage 50, main coil spring 52, bushing 54 and bushing rod 56 complete the contact trip assembly 40.

Figure 7:
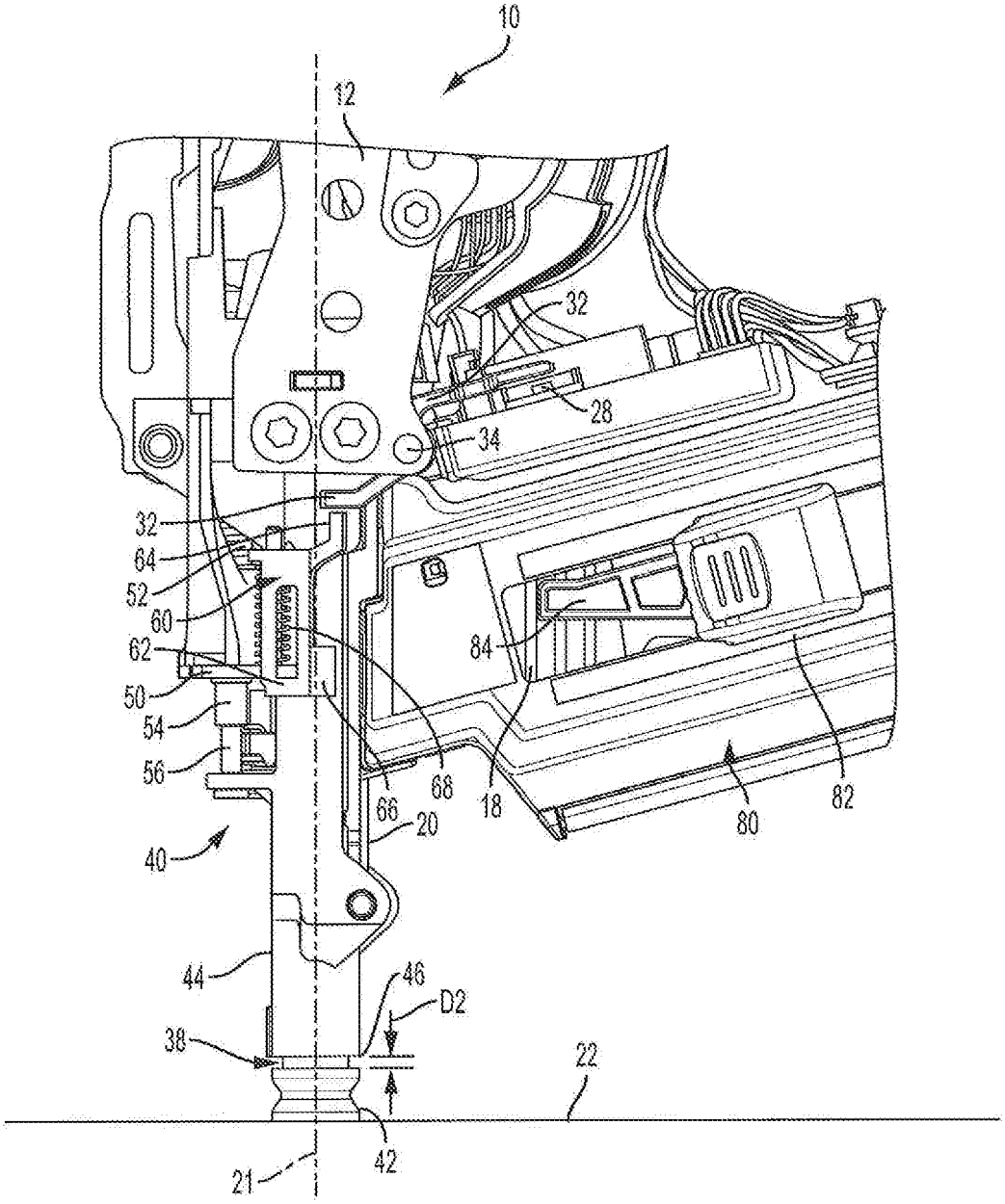
FIG. 7 is a partial elevational detail view, with parts removed for clarity, of the fastening tool of FIG. 1, illustrating the contact trip in the FIG. 5B position.
Figure 8:
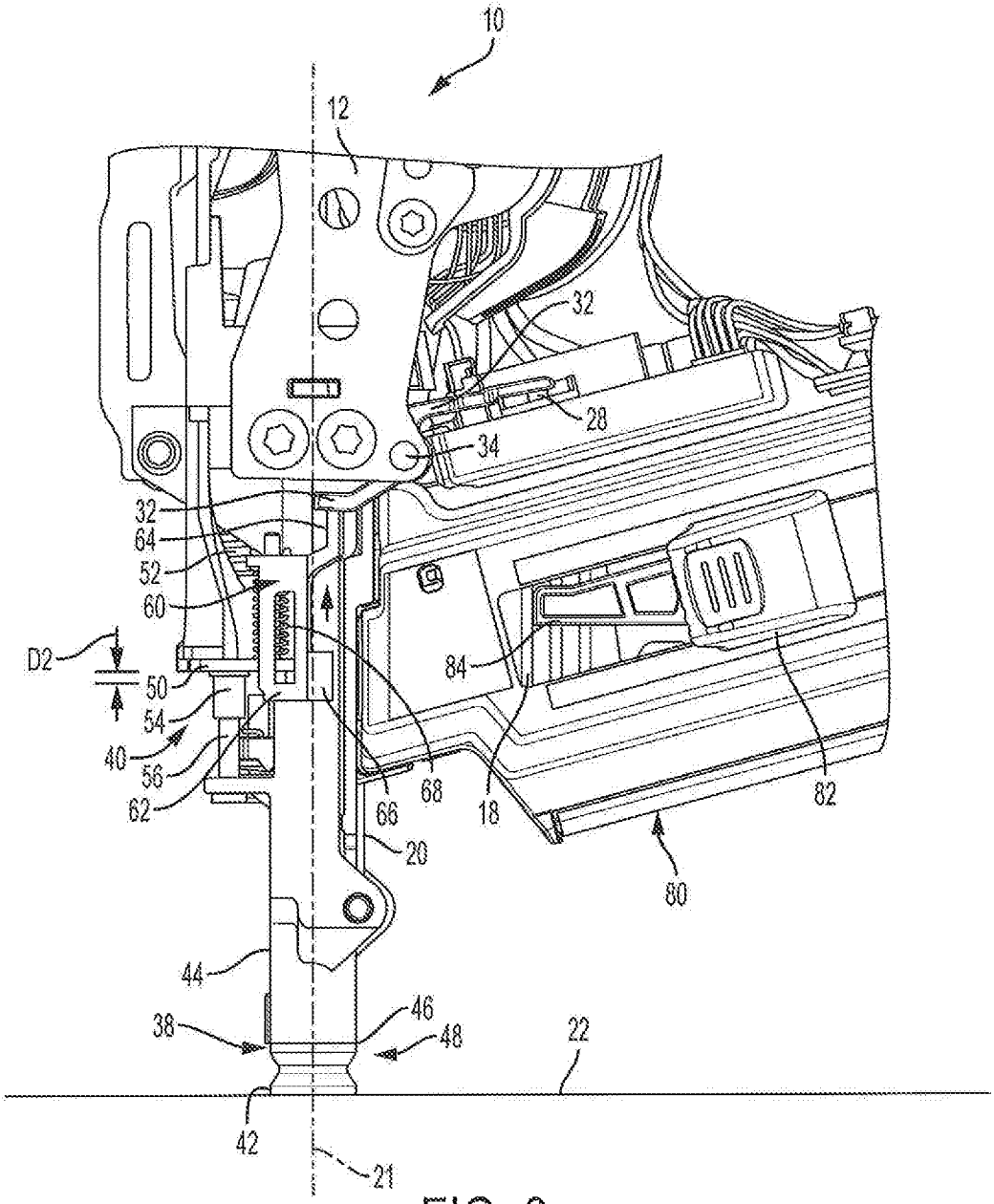
FIG. 8 is a view similar to that of FIG. 7, illustrating the contact trip in the FIG. 5C position.
Figure 9:
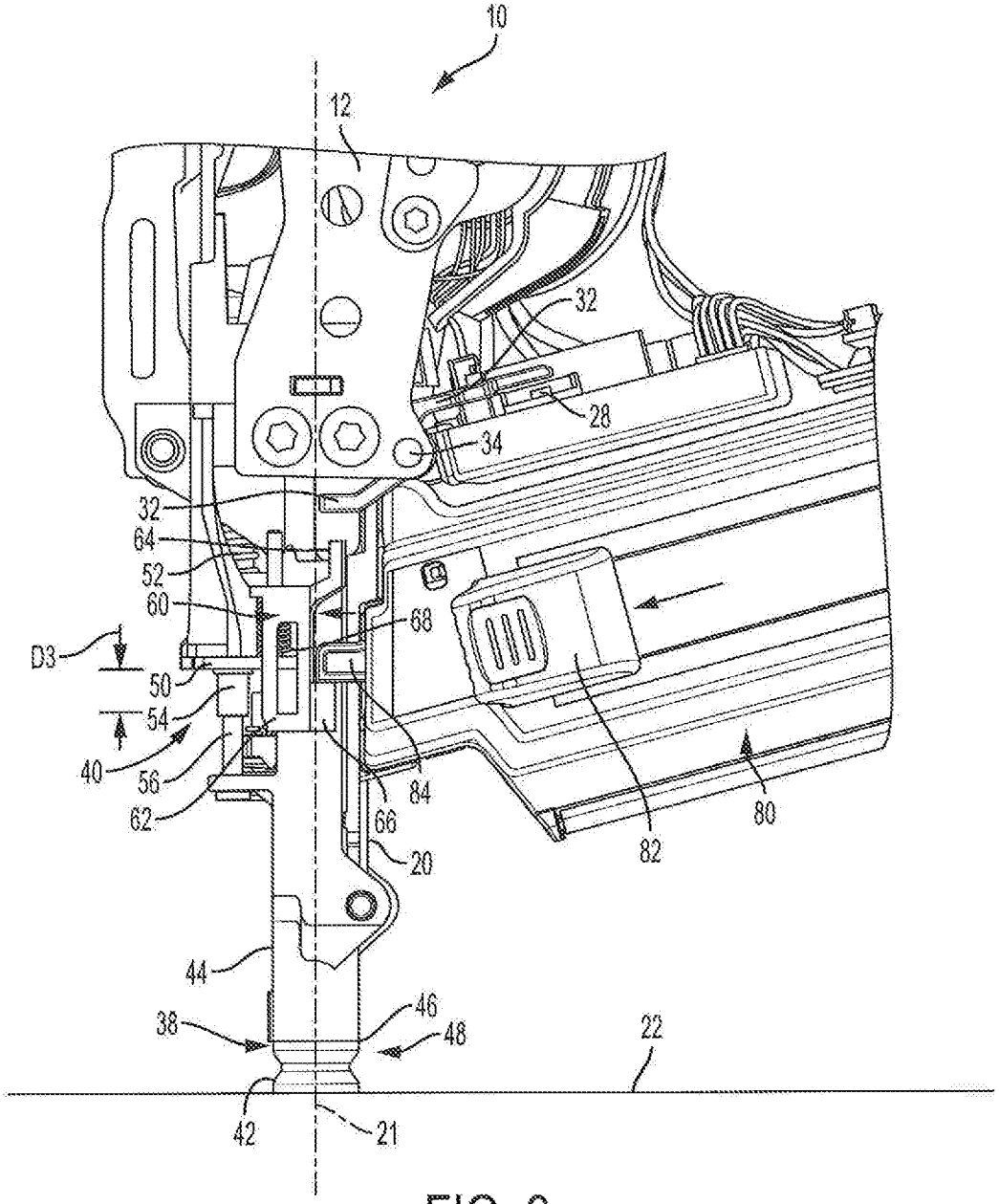
FIG. 9 is a view similar to that of FIG. 7, illustrating the contact trip in the FIG. 5D position.

The biasing agent housing assembly 60 is shown, for example, in FIGS. 7-9, and includes a biasing agent housing 62, a lever-engaging member 64 extending from the biasing agent housing and engageable with the switch lever 32, a blocking member 66, and a biasing agent 68. The biasing agent 68 is disposed in the biasing agent housing 62 between the appendage 50 and an upper surface 70 of the biasing agent housing (see FIGS. 5A-5D). The appendage 50 is movable independently of the biasing agent housing 62 within a slot (not shown) formed on one side of the biasing agent housing. When the appendage 50 moves upwardly in response to movement of the contact trip 38, the appendage pushes the biasing agent 68 upwardly, as well. This in turn pushes the biasing agent housing 62 toward engagement with the switch lever 32, unless movement of the biasing agent housing is blocked. In the embodiment shown in the Drawings, the biasing agent 68 is depicted as a coil spring. However it will be appreciated that the biasing agent 68 may take on other forms and include multiple elements, all of which will work satisfactorily provided they bias the biasing agent housing 62 in the direction of the switch lever 32.

As will be later described in more detail, the biasing agent 68 also takes on the function of a force-limiting or force take-up member, being configured to limit the force that the lever-engaging member 64 exerts upon the switch 28 to two pounds or less, even when an operator slams the contact trip 38 against an unyielding surface like concrete, or when the fastening tool 10 is dropped, nose-first, onto a hard surface.

Moving now to the magazine 80, and again referring to FIGS. 7-9, the magazine contains a supply of fasteners such as nails 18. A fastener pusher 82 is biased to push the nails 18 toward the drive track 20, along which a nail can be driven into a work surface 22 when the fastening tool 10 is fired. As shown in FIG. 9, when the supply of nails 18 reaches a dry-fire condition, for example, when the supply of nails reaches a predetermined minimum quantity, a pusher probe 84 extending from the fastener pusher 82 in the direction of the biasing agent housing 62 engages the blocking member 66, thereby blocking movement of the biasing agent housing 62 toward the lever 32, and thus preventing the fastening tool 10 from firing. The cooperation of the pusher probe 84 and the blocking member 66 can be adjusted so that the movement of the biasing agent housing 62 can be blocked when the remaining quantity of nails in the magazine 80 reaches any desired minimum, for example, from one to three nails. Blocking the movement of the biasing agent housing 62 constitutes a "bypass event", as will be discussed below.

Figures 5A, 5B, 5C, 5D:
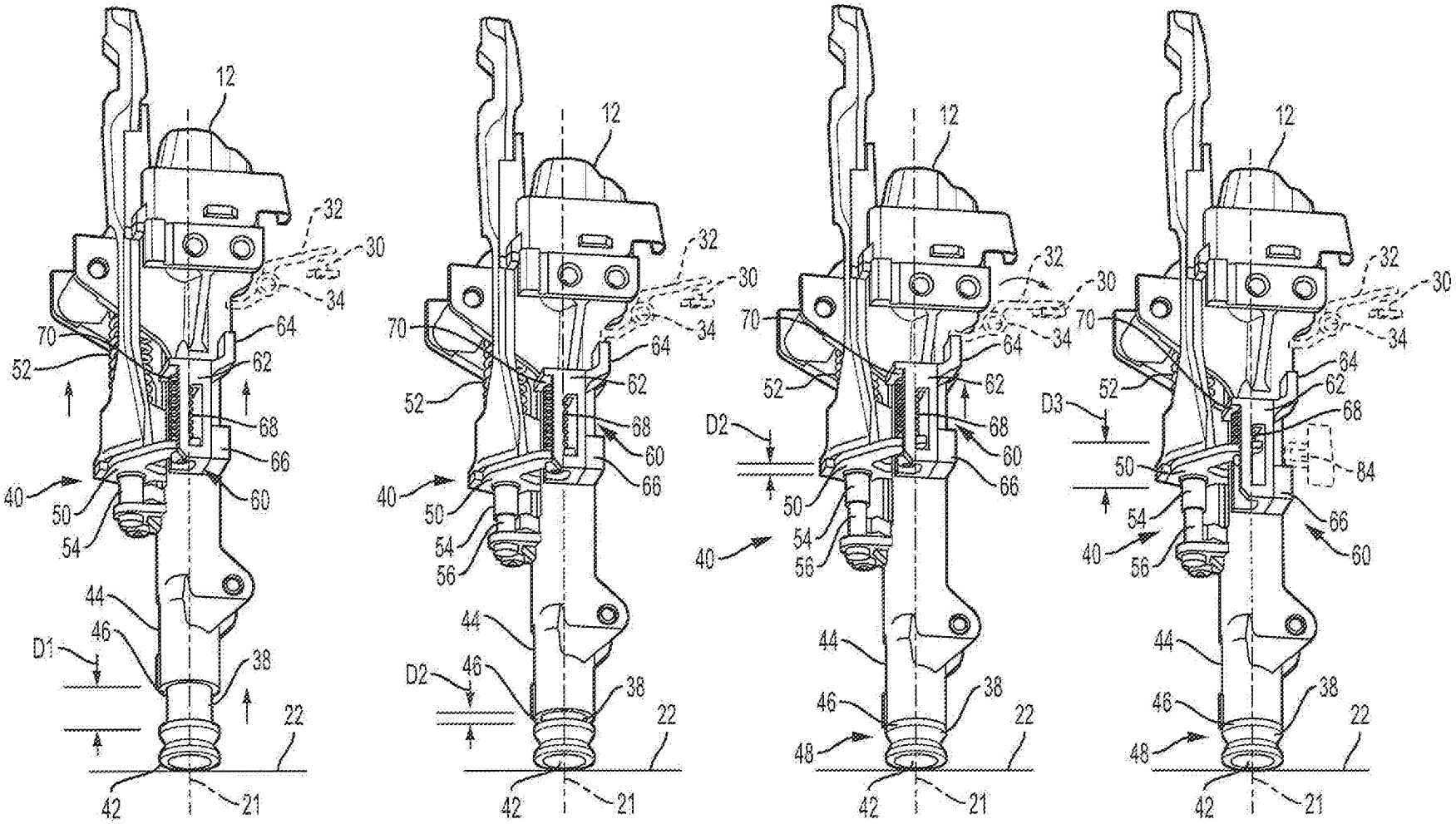
FIGS. 5A-5D are partial perspective detail views of a contact trip assembly responding, respectively, to three different vertical positions of the contact trip, and to a dry-fire condition of the magazine.

The operation of the dry-fire bypass system will be described with reference to FIGS. 5A-5D and 7-9. As shown in FIG. 5A, the contact trip 38 has touched the work surface 22, but no downward force has been exerted on the fastening tool 10 to fully depress the contact trip. Consequently, the toe 42 of the contact trip 38 remains spaced a distance D1 below the lower portion 46 of lower housing member 44. The distance D1 is precisely the amount of distance that the contact trip 38 travels when it moves from the position shown in FIG. 5A to the firing position 48, shown in FIG. 5C. The dry-fire bypass system will take up or absorb the entire distance D1, so that the effect of an upward movement of the contact trip will not be expended upon the contact trip switch 28. At the stage shown in FIG. 5A, the appendage 50 is located at its lowermost position, as is the biasing agent housing 62, inasmuch as the appendage 50 has yet to move the coil spring 68 upwardly against the upper surface 70 of the biasing agent housing.

As shown in FIGS. 5B and 7, the contact trip 38 has moved upwardly (see arrows in FIG. 5A), causing the appendage 50 to move the coil spring 68 upwardly, which in turn has caused the biasing agent housing 62 to move upwardly by the same amount, so that the lever-engaging member 64 is almost touching the lever 32. At this point, the contact trip toe 42 is only a small distance D2 from the lower portion 46 of the lower housing member 44. However, when the contact trip 38 reaches the firing position 48 shown in FIG. 5C, the incremental amount of upward movement D2 by the contact trip (and therefore the appendage 50) to the FIG. 5C position now causes the biasing agent housing 62 to engage lever 32 to close the contact trip switch 28. The contact trip switch 28 has thus assumed the firing condition, and the fastener drive system 14 is now armed.

FIGS. 5C and 8 show that, simultaneously with the upward movement of the contact trip 38, the appendage 50 moves upwardly by the same incremental amount D2, thereby slightly compressing the coil spring 68 within the biasing agent housing 62. The coil spring 68 has therefore taken up or absorbed the incremental amount of distance traveled by the contact trip 38 in ultimately reaching the firing position 48. In so doing, the coil spring 68 has assumed the role of a distance take-up member, responding to another type of bypass event, namely, the incremental movement of the contact trip 38 beyond a predetermined distance, which movement would otherwise exert a force greater than two pounds on the contact trip switch 28. Thus, the coil spring 68 has also acted to limit or take up the force exerted by the lever-engaging member 64 upon the fastener drive system arming device (switch lever 32 and contact trip switch 28). As can now be appreciated, the force-limiting action is consequently not limited to a dry-fire condition, but protects the arming device 36 even when the magazine 80 is loaded with fasteners 18.

The bypass arrangement of the present invention, in contrast to conventional dry-fire avoidance systems, allows the contact trip 38 to be disposed coaxially with the drive axis 21, thereby enabling a hard stop for the contact trip 38 to be located right at the lower portion 46 or base of the lower housing member 44. Accordingly, in the event the contact trip 38 is slammed against an unyielding surface, the hard stop dissipates the shock of the impact of the contact trip toe 42 throughout the inherently rugged housing 12 of the fastening tool 10, simultaneously with the coil spring 68 limiting the force which is ultimately applied to the contact trip switch 28.

After the fastening tool 10 has been lifted from the work surface 22, and in the absence of a dry-fire condition, the coil spring 68 returns to a relaxed condition, inasmuch as the contact trip 38 is biased by the main spring 52 normally to extend outwardly or downwardly from the fastening tool housing 12, thereby returning the appendage 50 to the position shown in FIG. 5A.

An example of the bypass action (or distance and force take-up) of the coil spring 68 is exhibited in the case of a dry-fire bypass event. In response to the quantity of remaining fasteners 18 in the magazine 80 having reached a minimum, the magazine pusher probe 84 cooperates with the blocking member 66 to block upward movement of the biasing agent housing 62, as shown in FIGS. 5D and 9. Here, although the biasing agent housing 62 has been rendered immobile, the contact trip 38 is still allowed to travel all of the way to the firing position 48. That is because the appendage 50, being movable independently of the biasing agent housing 62, is able to compress the coil spring 68 within the biasing agent housing 62 by an amount D3 to the position shown in FIGS. 5D and 9. The coil spring 68 thus takes up or absorbs all of the distance traveled by contact trip 38 in reaching the firing position 48. Consequently, movement of the contact trip 38 during the bypass event has effectively bypassed contact trip switch 28, which remains in the no-fire condition.

Figure 10:
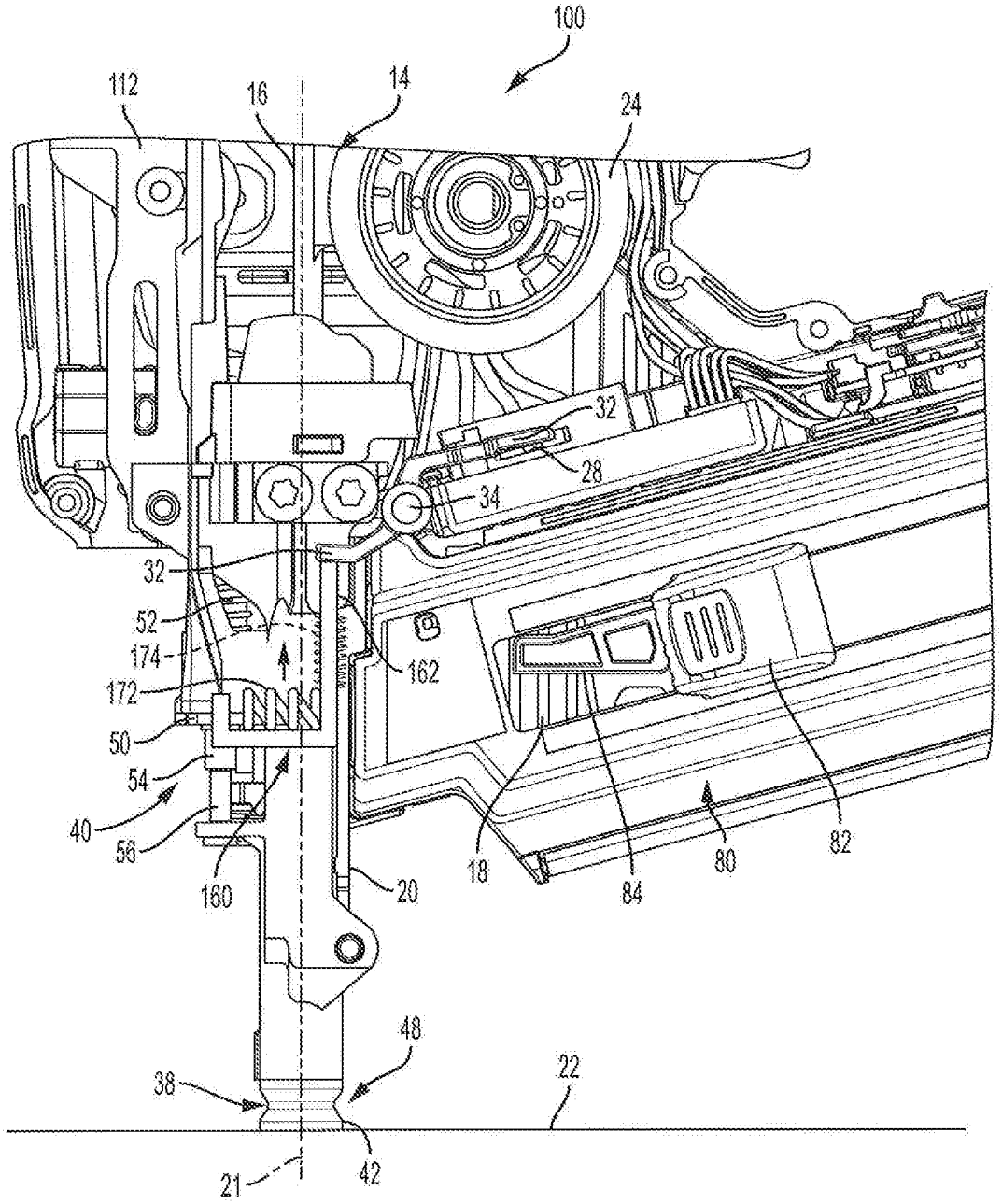
FIG. 10 is a view similar to that of FIG. 8, illustrating another embodiment of the fastening tool of the present invention.
Figure 11:
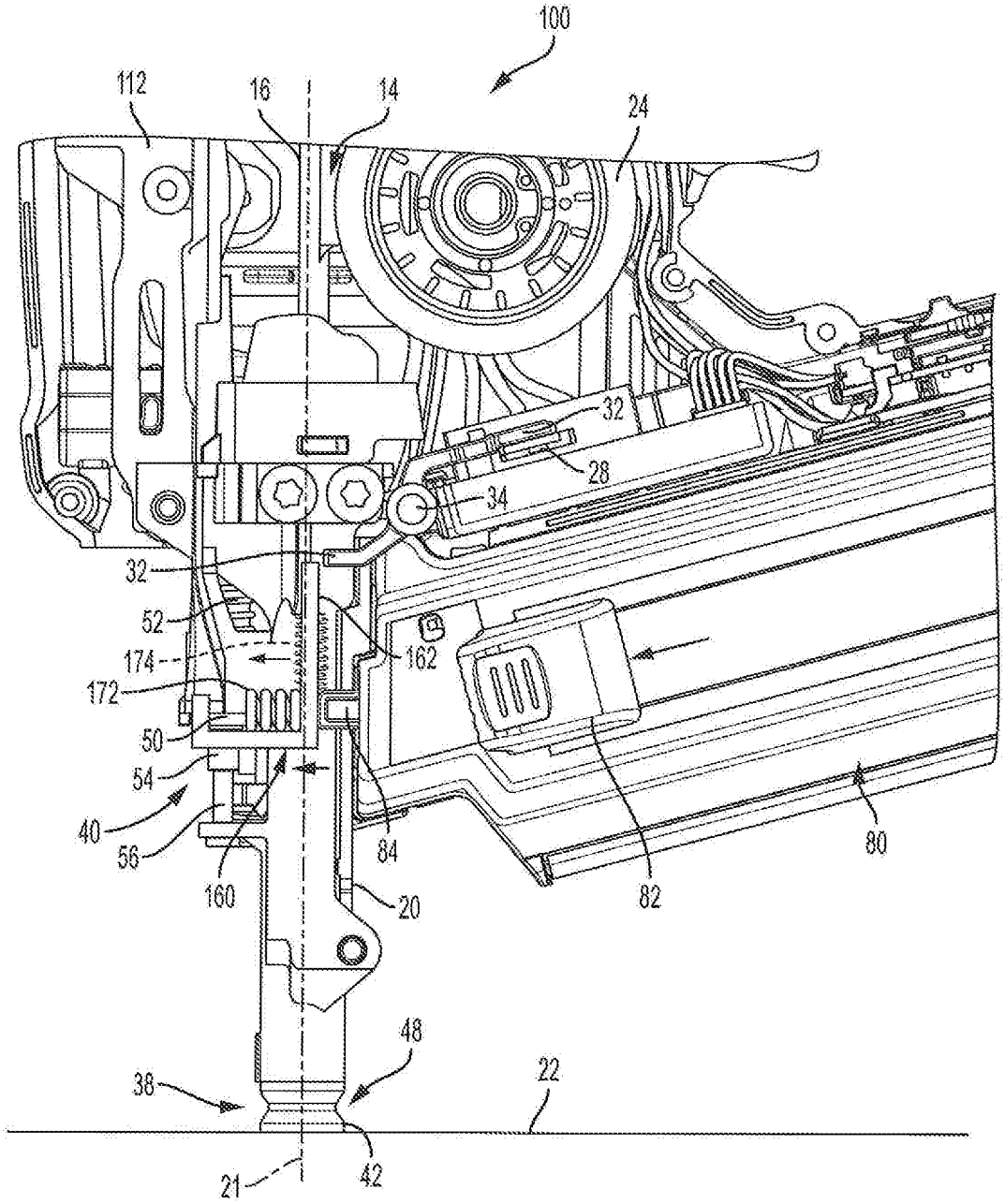
FIG. 11 is a view similar to that of FIG. 10, illustrating a fastener pusher causing the biasing agent housing of the embodiment of FIG. 10 to bypass the switch lever.

Another embodiment of the present invention 100 is shown in FIGS. 10 and 11. In this embodiment, a fastening tool 100 is disclosed. All of the elements of the fastening tool 10 of the present invention remain the same, except for a biasing agent housing 160, which is disposed on the appendage 50 for movement generally transverse to the direction of the movement of the appendage (which still moves vertically with the movement of the contact trip 38). The biasing agent housing 160 includes a vertical arm 162, which is aligned with the switch lever 32 so that upward movement of the biasing agent housing 160 will cause the vertical arm 162 to engage the switch lever. A biasing agent housing return spring 172 connected between the appendage 50 and the biasing agent housing 160 normally biases the biasing agent housing to the position shown in FIG. 10. If desired, a force take-up member or coil spring 174 (shown in phantom in FIGS. 10 and 11) may be operatively disposed between the biasing agent housing 160 and the appendage 52 to limit the force applied to the contact trip switch 28 to two pounds or less, as is similarly performed by the coil spring 68 in the first embodiment of the fastening tool 10. In operation, as shown in FIG. 10, when the contact trip 38 reaches the firing position 48, the appendage 50 moves the biasing agent housing 160 upwardly (as shown by the arrow) so that the biasing agent housing directly engages the lever 32 to close the contact trip switch 28, thereby placing the contact trip switch in the firing condition.

When a dry-fire bypass event occurs, as shown in FIG. 11, the pusher probe 84 pushes the vertical arm 162 of the biasing agent housing 160 horizontally away from alignment with the switch lever 32, as indicated by the arrows. Consequently, even if the contact trip 38 is pushed to the firing position 48, thereby moving the appendage 58 vertically a distance that would normally engage the switch lever 32 and close the contact trip switch 28, the vertical arm 162 of the biasing agent housing 160 completely misses or bypasses the switch lever 32, and the contact trip switch remains in the no-fire condition.

It can now be seen that the two embodiments of the fastening tool 10, 100 provide a method both for bypassing the fastener drive system arming device 36 during a dry-fire condition, and for limiting the force applied to the contact trip switch 28 as the contact trip 38 reaches the firing position 48, even when the magazine 80 is loaded with fasteners 18.

While the present invention has been described with respect to various embodiments of a concrete nailer, the present invention may be further modified within the spirit and scope of this disclosure to apply to other products as well. This application is therefore intended to cover any variations, uses, or adaptations of the present invention using its general principles. Further, this application is intended to cover such departures from the present disclosure as come within known or customary practice in the art to which this invention pertains and which fall within the limitations of the appended claims.

What is claimed is:

1. A method of bypassing an arming device of a fastener drive system disposed in a housing of a fastening tool, the arming device normally being responsive to movement of a fastening tool contact trip to a firing position to enable the fastener drive system to drive a fastener along a drive axis, comprising:

providing a biasing agent housing directly slidably engageable, in a longitudinal direction parallel to the drive axis, with the arming device, the biasing agent housing remaining generally parallel to the drive axis; and taking up a distance traveled by the contact trip when the contact trip moves toward the firing position so that the arming device remains in a no-fire condition.

2. The method claimed in claim 1, wherein the distance traveled by the contact trip is taken up in response to a bypass event.

3. The method claimed in claim 2, wherein the bypass event includes the contact trip having moved a distance exceeding a predetermined amount.

4. The method claimed in claim 2, further comprising:

providing a biasing agent operatively connected to the contact trip; and engaging the biasing agent with the biasing agent housing.

5. The method claimed in claim 4, wherein the bypass event includes a force exceeding two pounds being exerted upon the biasing agent by the contact trip.

6. The method claimed in claim 4, wherein the biasing agent housing is responsive to movement of the contact trip, and enables the fastener drive system to drive a fastener, wherein the biasing agent housing is movable independently of the contact trip in response to the bypass event, and wherein the bypass event prevents the biasing agent housing from engaging the arming device of the fastener drive system.

7. The method claimed in claim 6, further comprising:

providing a fastener magazine having a pusher, the fastener magazine being connected to the fastening tool housing; and blocking the biasing agent housing with the pusher when fasteners in the fastener magazine having reached a minimum quantity.

8. The method claimed in claim 1, wherein the biasing agent housing moves parallel to the contact trip.

9. The method claimed in claim 1, further comprising the step of blocking movement of the biasing agent housing in response to a bypass event.

10. The method claimed in claim 9, wherein the step of blocking movement of the biasing agent housing occurs before the step of taking up a distance traveled by the contact trip.

11. The method claimed in claim 1, further comprising a biasing agent housed within the biasing agent housing.

* * * * *